United States Patent [19]

Norris et al.

[11] 4,106,896

[45] Aug. 15, 1978

[54] METHOD FOR PRODUCING MULTICOLOR PRINTED WEB MATERIAL

[75] Inventors: Alan Hedley Norris; Phillip Wayne Chambley, both of Rome, Ga.

[73] Assignee: Champion International Corporation, Stamford, Conn.

[21] Appl. No.: 766,214

[22] Filed: Feb. 7, 1977

[51] Int. Cl.[2] ..... D06P 5/12; D06P 5/22

[52] U.S. Cl. ..... 8/62; 8/1 XB; 8/65; 8/66; 8/73

[58] Field of Search ..... 8/73, 1 XB, 62, 65, 8/66

[56] References Cited

U.S. PATENT DOCUMENTS

| | | | |
|---|---|---|---|
| 3,743,477 | 7/1973 | Egli et al. | 8/66 |
| 3,989,453 | 11/1976 | Jilla | 8/66 |
| 4,005,230 | 1/1977 | Fleissner | 8/62 |

FOREIGN PATENT DOCUMENTS

| | | | |
|---|---|---|---|
| 251,082 | 11/1963 | Australia | 8/1 XB |
| 1,392,390 | 4/1975 | United Kingdom | 8/1 XB |

OTHER PUBLICATIONS

Head-End Dyeing Procedures: Dupont Technical Information (Multifiber, Bulletin X236, Jan. 1974.

*Primary Examiner*—John Kight, III
*Attorney, Agent, or Firm*—Evelyn M. Sommer

[57] ABSTRACT

A method is described for producing a multicolor printed web material such as a carpet substantially without spoilage of production web material during a start-up of a printing process employing a plurality of dyes applied in different patterns. A lead carpet is formed which is non-receptive to the dyes. The lead carpet is attached to the production carpet and the dye patterns tested on the lead carpet. After correction, if necessary, for print misalignments and other dye printing station operations, the production carpet is printed. Both lead and production carpets are processed to fix the dyes and remove excess non-fixed dyes. The removal step results in cleaning of the lead carpet on which the dyes were not fixed. The lead carpet is then disconnected and made available for another print start-up.

10 Claims, 1 Drawing Figure

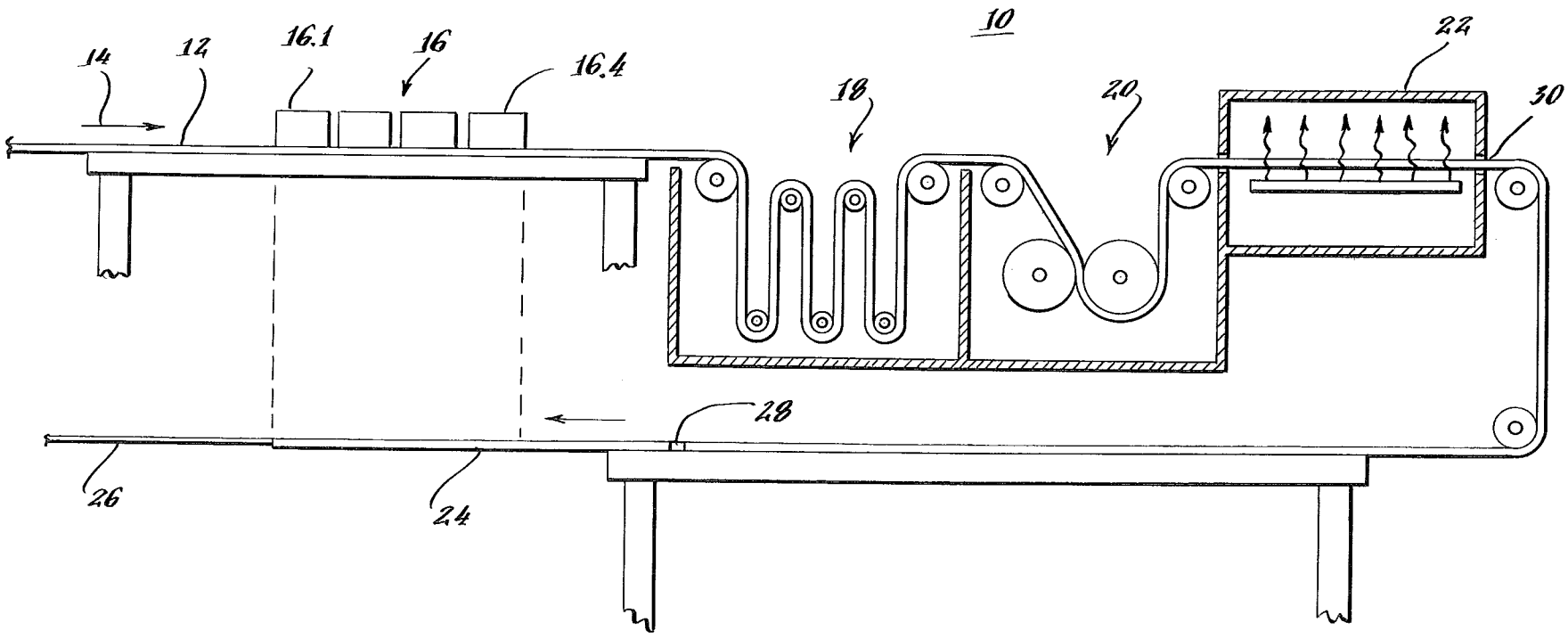
10
14
14
16.1
16
16.4
18
20
22
24
26
28
30

METHOD FOR PRODUCING MULTICOLOR PRINTED WEB MATERIAL

FIELD OF THE INVENTION

This invention relates to a method for producing multicolor printed web material. More specifically, this invention relates to a method for making a multicolor printed carpet.

BACKGROUND OF THE INVENTION

In the manufacture of multicolor printed web material such as carpets, multiple imprints on the same portion are made with different colored dyes. Care must be taken that the respective patterns are properly aligned, have the correct color and that the printing dyes are applied in the precise amount for optimum printing without blurring of the composite pattern.

The U.S. Pat. No. 3,974,766 to Zimmer is exemplary of a system for printing a composite pattern on a web carpet while using sensing devices with a memory unit to provide control over registration. The Zimmer system relies upon web sensing devices which identify specific web areas where printing may be required. The Zimmer system is complex and does not provide automatic control over the quality of the printing such as may be caused by variations in the dyes, squeegee pressure and the like.

When, for example, a number of dye printing stations are employed in a large carpet printing system such as described in the U.S. Pat. No. 3,374,731 to Thorne, it is necessary to check that each print strike is properly aligned with the appropriate squeegee or pump pressure for the screens. In practice, the initial feet of a blank carpet are employed to adjust the printing stations. As a result, the front segment of a carpet frequently has inferior quality printing and is likely to be unusable.

In practical carpet printing operations, frequent start-ups using different patterns occur, with as many as three start-ups per day being common. When the total carpet spoilage is considered as a result of frequent start-ups, the financial loss is significant.

SUMMARY OF THE INVENTION

In accordance with one technique for producing a multicolor printed web material in accordance with the invention, a reusable lead web segment is employed. The lead web segment is non-receptive to the dyes employed in the printing system and attached to the front end of the production web material. The printing operation is checked and adjusted by observing the print strikes on the lead web segment.

Since the lead web segment is non-receptive to the dyes, the latter are removed during the normal subsequent web processing which includes a dye-washing step. The cleaned lead web segment is then disconnected from the production web and made available for another print start-up.

The reduction of spoiled web with a reusable lead web segment can be significant particularly in a carpet printing operation. A lead carpet is formed which is non-receptive to the dyes employed. The lead carpet preferably has the same characteristics as the production carpet so that the printing tests made on the lead carpet are valid examples of print strikes on the following production carpet.

The lead carpet is attached to the production carpet and advanced past dye printing stations where print strikes are made and printing station adjustments are implemented if necessary. After the desired printing quality is achieved on the lead carpet, the production carpet is printed. Both the lead and production carpets are passed through conventional carpet processes which include a wash cycle where non-fixed dyes are removed. The dyes deposited on the non-receptive lead carpet are thus washed off and it completes the processing in a reusable condition. Thousands of yards of normally spoiled production carpet can thus be saved.

It is, therefore, an object of the invention to reduce spoilage of carpet from a carpet printing operation. It is a further object of the invention to improve the printing efficiency in a web material printing process.

These and other objects and advantages of the invention can be understood from the following description of a web printing method in accordance with the invention and described in conjunction with the drawing.

BRIEF DESCRIPTION OF DRAWING

The FIG. is a schematic representation of a web carpet printing system employing a carpet printing technique in accordance with the invention.

DETAILED DESCRIPTION OF EMBODIMENT

With reference to the Figure, a carpet printing system 10 is shown for printing of dye patterns on a carpet web 12 advanced through system 10 in the direction of arrow 14. The printing system 10 is of a conventional type in that it employs a plurality of screen dye printing stations 16 followed by further processing such as a dye fixing step in a steamer 18, a washing step in a carpet washer 20 where non-fixed dyes are removed and a drying step in a drier 22. The dye printing stages 16 incorporate so-called silk screens i.e., screens constructed on the basis of polyester, metal wire or perforated metal film materials, which are applied to strike the carpet 12 and deposit a dye pattern through the screen under action by a squeegee or other suitable dye pumping action. Though four dye stages are shown, more may be used. A carpet may undergo but several print strikes or many more, depending upon the number of available dye printing stations 16.

Since the dye patterns form a composite pattern, proper operation of each station is essential to produce a high quality printed carpet. For example, pattern alignments may be slightly off or the pump pressure at a station too high and thus deposit an excessive amount of dye.

In practice the initial pass of the carpet 12 past the printing stations 14 indicates such screen misalignment or other need for station operational adjustment. As a result, some initial yards of second quality or spoiled printed carpet is normally produced and this tends to increase with more complex patterns.

In the practice of a carpet printing method in accordance with the invention, a reusable lead carpet 24 is attached behind a jute header 26 and to the front edge 28 of the production carpet 12. The lead carpet 24 has the same lateral dimension as the production web 12. The lead carpet 24 is non-receptive to the dyes employed in the printing stations 16.

The term non-receptive as used in this application refers to a characteristic in the lead web segment whereby the latter can accept dye print strikes to check proper operation of the stations but the deposited dyes remain non-fixed and removable during further processing of the web.

There are several methods available for forming the lead carpet 24 which is non-receptive to the dyes. For example, in one method where the production carpet employs a pile formed of nylon, a segment of the production carpet in the grey state is passed through a process wherein the nylon dye sites are stuffed with colorless chemicals. Compounds, among many, which can be used for this purpose may be such as IRGA PRINT PA produced by the Ciba Geigy Corporation, P.O. Box 11422, Greensboro, N.C. 27406; SANDOSPACE R, produced by the Sandoz Colors and Chemicals, Rt. 10, East Hanover, N.J. 07936 and MIGRASSIT NYL, produced by the Tanatex Chemical Company, Division of Sylron Corporation, P.O. Box 388, Lyndhurst, N.J. 07071. Similar procedures can be applied to carpets made of different fibers.

Another method for rendering the lead carpet 24 non-receptive involves the selection of a different yarn for the lead segment from that used in the production carpet. Such different yarn is selected on the basis that the dyes, which are useful for the production carpet, remain removable after deposit on the lead segment and exposure to the dye fixing step such as in steamer 18. An example of such non-receptive lead segment is a lead carpet 24 formed with a polyester yarn when the production carpet is made with a nylon yarn and is printed with acid dyes.

The lead carpet 24 is further preferably selected to possess a similar printing characteristic as the production carpet. For example, when the production carpet has a latex foamed back, the lead carpet is also provided with a foam backing. However, a more durable foam is preferred for a reusable lead carpet such as a foam backing formed of a urethane whose thickness and compressibility match the foam backing of the production carpet.

The lead carpet 24 further is preferably provided with a similar printing surface as the production carpet 12. This is achieved when the lead carpet is cut from the production carpet and subsequently made non-receptive to the dyes in a chemical treatment. However, when the lead carpet 24 is made with a different yarn, the character of its printing surface, whether tufted or otherwise, is selected similar to that of the production carpet 12.

In the operation of a carpet printing method in accordance with this invention, the jute header is connected to a non-receptive lead carpet segment 24 with suitable attachments. The lead carpet 24 in turn is attached to the production carpet 12 with loose stitching, removable clips and the like, such as stapel 28.

The initial printing by the dye printing stations 16 is carried out on the lead carpet 24. The latter's length is selected at least sufficient to accept a print strike from each printing station 16 before the production carpet 12 enters printing stations 66. All printing errors can then be noted and appropriate operating adjustments made at the dye printing stations 16. Production carpet printing can then proceed.

The printed lead carpet 24 and the printed production carpet 12 are passed through the steamer 18, washer 20 and drier 22. Since no dye fixation occurs on the non-receptive lead carpet, all the dye printed thereon is removed in the washer 20. Hence, when the lead carpet 24 emerges at the drier exit 30, the lead carpet is clear and free of dyes. The lead carpet is then disconnected from the production carpet by removal of connecting devices 28 for reuse in the next print run.

Having thus described a method for printing web material such as carpets in accordance with the invention, its advantages can be appreciated. The reusable lead carpet saves a high amount of carpet spoilage which is normally encountered in a carpet dye printing systems. For example, if three print runs occur each day on a system such as 10, an average waste of about forty yards per start-up may occur. With a web printing technique in accordance with the invention, thousands of yards of production carpet spoilage can be avoided each year.

What is claimed is:

1. A method for producing a multicolor printed web material with dyes which are applied in separate patterns at dye printing stations on a common production web comprising the steps of attaching a lead web segment which is non-receptive to the dyes and of sufficient length to receive the respective printing patterns to the production web;

advancing the lead web segment followed by the attached production web past the dye printing stations to print said dye patterns thereon;

adjusting the printing operation at the dye printing stations to establish proper printing patterns on the lead web segment;

processing the dye printed lead web segment and the attached printed production web to fix the dyes on the production web;

said processing step including the step of washing of the lead web segment and the production web to remove non-fixed dyes therefrom and produce a reusable lead web segment from which the dye patterns have been effectively removed.

2. The method for producing the multicolor printed web material as claimed in claim 1 wherein the processing step is followed by the step of disconnecting the lead web segment from the production web for reuse of the lead web segment with another production web on which multicolor patterns are to be formed with the dye printing stations.

3. The method for producing the multicolor printed web material as claimed in claim 1 wherein the attaching step further includes the steps of selecting the lead web segment of the same material as the production web, and treating said lead web segment to render it non-receptive to the dyes.

4. The method for producing the multicolor printed web material as claimed in claim 1 wherein the attaching step further includes the step of selecting the lead web segment of a material which is non-receptive to the dyes.

5. A method for producing a multicolor printed carpet with dyes which are applied in separate patterns at dye printing stations on a common production carpet comprising the steps of forming a lead carpet which is non-receptive to the dyes and of sufficient length to receive the respective printing patterns;

attaching the lead carpet to the production carpet;

advancing the lead carpet followed by the attached production carpet past the dye printing stations and adjusting the printing operation at the dye printing stations to establish proper printing patterns on the lead carpet;

printing said patterns on the production carpet;

processing the dye printed lead carpet and the attached production carpet to fix the dyes on the production carpet;

said processing step including the step of washing of the lead carpet and the production carpet to remove non-fixed dyes therefrom and produce a reusable lead carpet from which the dye patterns have been effectively removed; and disconnecting the lead carpet from the printed production carpet for reuse of the lead carpet.

6. The method for producing a multicolor printed carpet as claimed in claim 5 wherein the lead carpet forming step further includes the step of selecting a lead carpet which has a printing surface formed of the same material as the printing surface of the production carpet and treating the selected lead carpet to render it non-receptive to the dyes.

7. The method for producing a multicolor printed carpet as claimed in claim 5 wherein the production carpet has a foamed backing and wherein the lead carpet forming step includes the step of selecting a lead carpet with a backing material which matches the backing of the production carpet in thickness and compressibility.

8. The method for producing a multicolor printed carpet as claimed in claim 7 wherein the backing material for the lead carpet is formed of a urethane foam for durability and multiple reuse of the lead carpet.

9. The method for producing a multicolor printed carpet as claimed in claim 5 wherein the lead carpet forming step further includes the step of selecting a lead carpet with a printing surface formed of a material which is different from the printing surface of the production carpet and non-receptive to the dyes.

10. The method for producing a multicolor printed carpet as claimed in claim 9 wherein said lead carpet is formed with a printing surface material made with a polyester yarn.

* * * * *